US006647837B2

(12) United States Patent
Liou

(10) Patent No.: US 6,647,837 B2
(45) Date of Patent: Nov. 18, 2003

(54) HAND TOOL

(76) Inventor: Mou-Tang Liou, No. 57, Kung Yeh North Road, Nan Kang Industrial Park, Nantou Hsien (TW)

( * ) Notice: Subject to any disclaimer, the term of this patent is extended or adjusted under 35 U.S.C. 154(b) by 0 days.

(21) Appl. No.: 10/118,288

(22) Filed: Apr. 8, 2002

(65) Prior Publication Data

US 2003/0110909 A1 Jun. 19, 2003

(30) Foreign Application Priority Data

Dec. 19, 2001 (TW) ..... 90131977 A

(51) Int. Cl.[7] ..... B25B 19/00
(52) U.S. Cl. ..... 81/466; 173/93; 81/463
(58) Field of Search ..... 81/466, 465, 463; 173/93, 93.7, 119, 93.6

(56) References Cited

U.S. PATENT DOCUMENTS 5,012,709 A * 5/1991 Su ..... 81/466
5,321,999 A * 6/1994 Lin ..... 81/463
6,370,993 B1 * 4/2002 Pitstick ..... 81/463
6,524,035 B1 * 2/2003 Robison ..... 408/211

* cited by examiner

*Primary Examiner*—Lee D. Wilson
(74) *Attorney, Agent, or Firm*—Alan D. Kamrath; Rider Bennett, LLP.

(57) ABSTRACT

A hand tool includes a handle, a plunger, an elastic element, a driver, a device for transforming a blow into a torque and a clutch. The handle is hollow. The plunger includes a first end and a second end. The plunger is inserted in the handle so that it cannot rotate relative to the handle and that the second end extends beyond the handle. The elastic element is received in the handle. The driver includes a first section for engagement with a tool bit and a second section received in the handle so that it can rotate relative to the handle. The transforming device is arranged between the plunger and the driver for transforming a blow on the second end of the plunger into a torque on the second section of the driver. The clutch is mounted on the first section of the driver so that it cannot rotate relative to the driver and can move between a first position where it cannot rotate relative to the handle and a second position where it can rotate relative to the handle.

19 Claims, 12 Drawing Sheets

HAND TOOL

BACKGROUND OF INVENTION

1. Field of Invention

The present invention is related to a hand tool that in a mode can transform a blow into a torque and in another mode can work as an ordinary screwdriver.

2. Related Prior Art

FIG. 12 shows a conventional hand tool 100 that is capable of transforming a blow into a torque. The hand tool 100 includes a handle 101 that is hollow and includes an open end 102 and a closed end. The handle 101 includes a neck 103 of a reduced diameter formed thereon near the open end 102. A V-shaped slot 104 is defined in the neck 103. A spring 105 is received in the handle 101. A shaft 106 includes a square end for engagement with a tool bit. A recess 107 is defined in the periphery of the shaft 106. The shaft 106 is partially inserted in the handle 101 so that the recess 107 is aligned with the V-shaped slot 104. A pin 108 is inserted through the V-shaped slot 104 and received in the recess 107. An elastic collar 109 is mounted on the neck 103, thus retaining the pin 108 in position. A blow exerted on the closed end of the handle 101 by a hammer can be transformed into a torque exerted on the shaft 106 due to the engagement of the V-shaped slot 104 with the pin 108. Thus, a user can exert a greater torque than he can with an ordinary screwdriver. Therefore, the conventional hand tool 100 is used at a final stage of tightening a threaded bolt and at an initial stage of releasing a threaded bolt. However, the hand tool 100 is less useful than an ordinary screwdriver in other situations. In addition, the hand tool 100 cannot be used to carry tool bits that can easily be forgotten and lost.

The present invention is therefore intended to obviate or at least alleviate the problems encountered in the prior art.

SUMMARY OF INVENTION

It is the primary object of the present invention to provide a hand tool that in a mode can transform a blow into a torque and in another mode can work as an ordinary screwdriver.

According to the present invention, a hand tool includes a handle, a plunger, an elastic element, a driver, a device for transforming a blow into a torque and a clutch. The handle is hollow. The plunger includes a first end and a second end. The plunger is inserted in the handle so that it cannot rotate relative to the handle and that the second end extends beyond the handle. The elastic element is received in the handle. The driver includes a first section for engagement with a tool bit and a second section received in the handle so that it can rotate relative to the handle. The transforming device is arranged between the plunger and the driver for transforming a blow on the second end of the plunger into a torque on the second section of the driver. The clutch is mounted on the first section of the driver so that it cannot rotate relative to the driver and can move between a first position where it cannot rotate relative to the handle and a second position where it can rotate relative to the handle.

The hand tool may include a device formed around the handle for storing tool bits. The storing device includes two shells pivotally mounted on the handle for carrying tool bits. Each of the shells includes an semi-annular portion defining a plurality of recesses for receiving tool bits.

The hand tool may include a telescopic element that is attached thereto and includes a magnetic end.

Other objects, advantages, and novel features of the invention will become more apparent from the following detailed description when taken in conjunction with the attached drawings.

BRIEF DESCRIPTION OF DRAWINGS

The present invention is described through detailed illustration of embodiments referring to the attached drawings wherein.

DETAILED DESCRIPTION OF PREFERRED EMBODIMENTS

Figure 1:
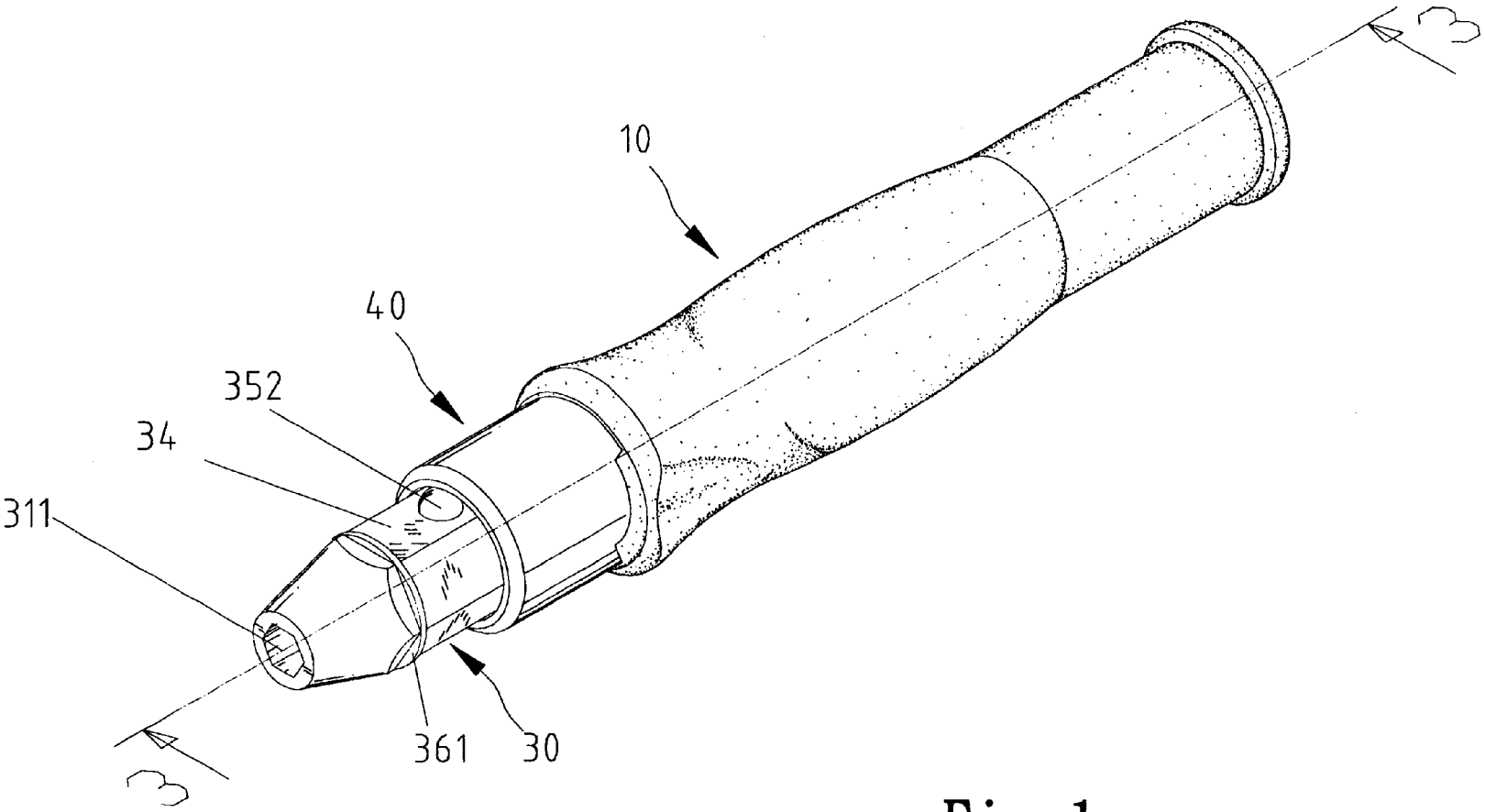
FIG. 1 is a perspective view of a hand tool according to a first embodiment of the present invention.
Figure 2:
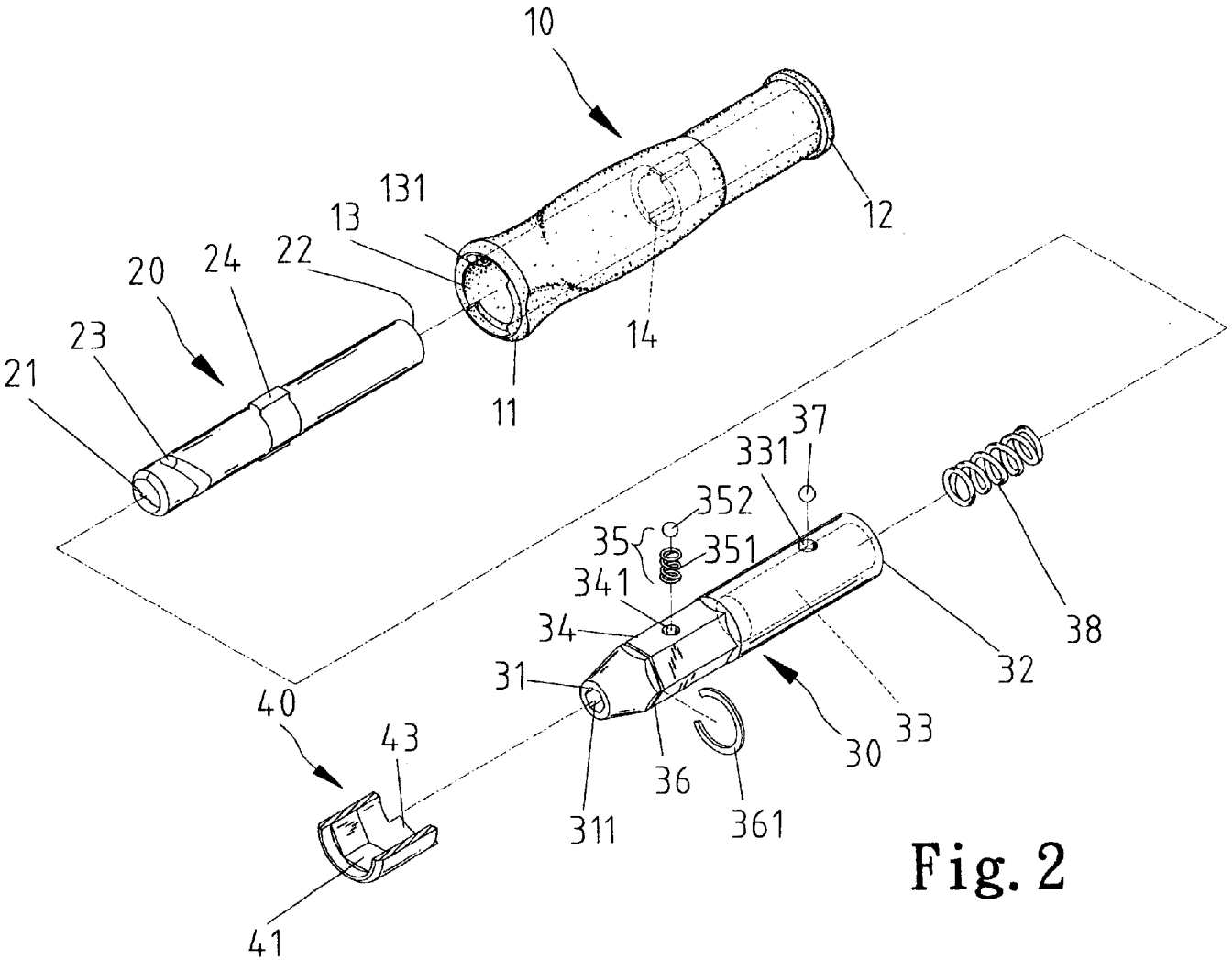
FIG. 2 is an exploded view of the hand tool shown in FIG. 1.

Referring to FIGS. 1 and 2, according to a first embodiment of the present invention, a hand tool includes a handle 10, a plunger 20, a driver 30 and a clutch 40.

The handle 10 is formed with a first open end 11 and a second open end 12. The handle 10 defines a space 13 in communication with the open ends 11 and 12 thereof. Thus, the handle 10 includes an external periphery and an internal periphery. The space 13 includes a first section and a second section of a smaller diameter than that of the first section thereof. Two recesses 131 are defined in the internal periphery of the handle 10 at the first open end 11. Similarly, two grooves 14 are axially defined in the internal periphery of the handle 10 at the second section of the space 13.

The plunger 20 includes a first end 21 and a second end 22. A V-shaped groove 23 including first and second branches is defined in the periphery of the plunger 20 near the first end 21. Two guides 24 axially extend on the periphery of the plunger 20.

Referring to FIGS. 3 through 7, the plunger 20 is inserted in the handle 10 so that the second end 22 of the plunger 20 is exposed through the second open end 12 of the handle 10, that the guides 24 are received and can slide in the grooves 14, that the first end 21 of the plunger 20 is received in the first section of the space 30.

A spring 38 is received in the first section of the space 13.

The driver 30 includes a first section 31 and a second section 32. A hexangular hole 311 is defined axially in the first section 31 of the driver 30. The first section 31 of the driver 30 is formed with a hexangular periphery 34 that consists of six facets. A hole 341 is defined in one of the facets of the hexangular periphery 34 in order to receive a retainer assembly 35 consisting of a spring 351 and a ball 352. An annular groove 36 is defined in the hexangular periphery 34 for receiving a C-clip 361. The second section 32 of the driver 30 defines a space 33, thus the second section 32 of the driver 30 includes an internal periphery and an external periphery. The internal periphery of the second section 32 defines a hole 331 in order to receive a ball 37.

The second section 32 of the driver 30 is inserted in the first section of the space 13 defined in the handle 10 so that the first end 21 of the plunger 20 is received in the space 33 defined in the second section 32 of the driver 30. The spring 38 is received in the space 33 and has a first end 381 abutting with the first end 21 of the plunger 20 and a second end 382 abutting with the axial end of the space 33. The hole 331 is aligned with the V-shaped groove 23 so that the ball 37 can be received in the hole 331 and the V-shaped groove 23.

The clutch 40 is shaped as a collar, thus including an internal periphery 41 and an external periphery. The internal periphery 41 consists of a plurality of facets corresponding to that of the first section 31 of the driver 30 and in the form shown is hexangular for engagement with the hexangular periphery 34 of the first section 31 of the driver 30. The clutch 40 includes an annular edge 44 on a first end thereof and two extensions 43 extending from a second end thereof. Six crescent shoulders 42 are formed between the hexangular internal periphery 41 and the annular edge 44.

The spring 351 is received in the hole 341. The ball 352 is partially received in the hole 341. The clutch 40 is mounted on the first section 31 of the driver 30. The spring 351 and the ball 352 are retained in the hole 341 by means of the clutch 40. The extensions 43 are aligned with the recesses 131. The C-clip 361 is received in the annular groove 36, thus retaining the clutch 40 on the first section 31 of the driver 30.

Figure 3:
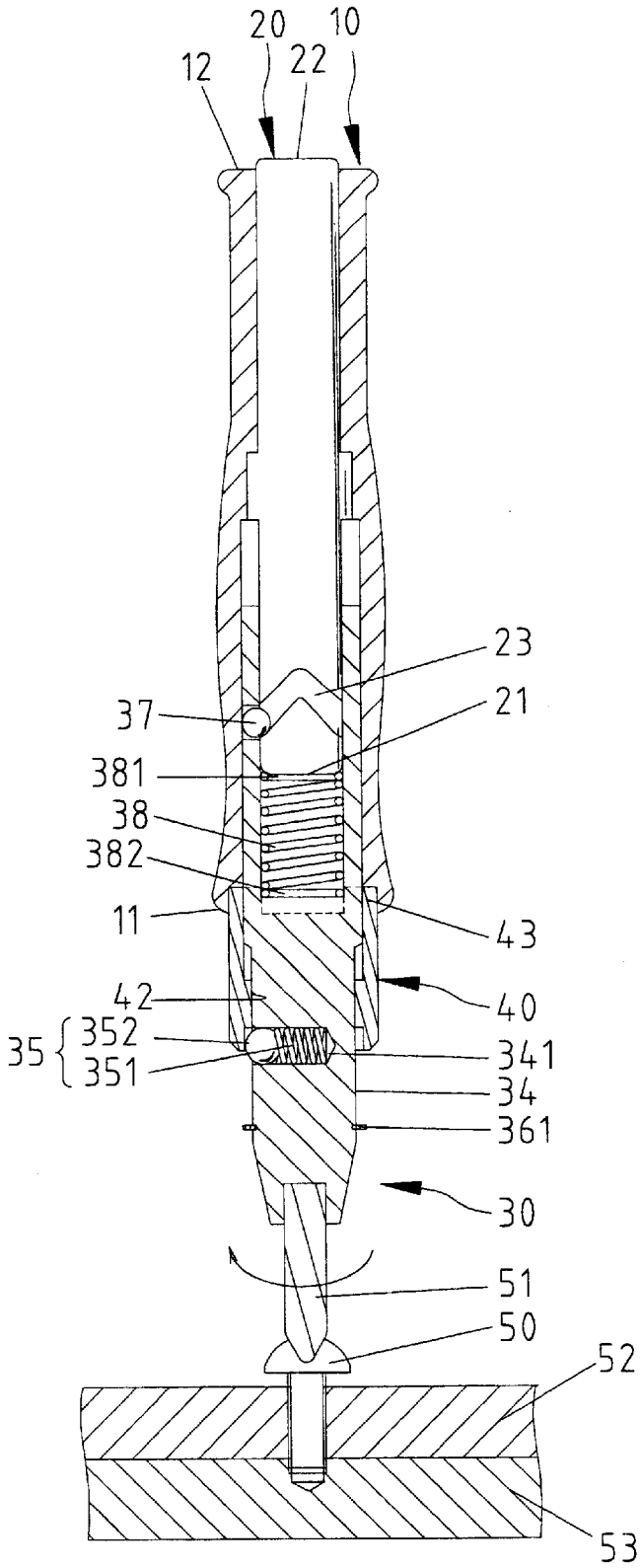
FIG. 3 is a cross-sectional view of the hand tool according to section line 3—3 shown in FIG. 1.

Referring to FIG. 3, the extensions 43 are inserted in the recesses 131 so that the handle can drive the clutch 40. As the hexangular internal periphery 41 engages with the hexangular periphery 34, the clutch 40 can drive the driver 30. Thus, the handle 10 can drive the driver 30. The driver 30 can drive a tool bit 51 that can drive a screw 50 such as for securing members 52 and 53 together. Obviously, the hand tool works as an ordinary screwdriver.

Figure 4:
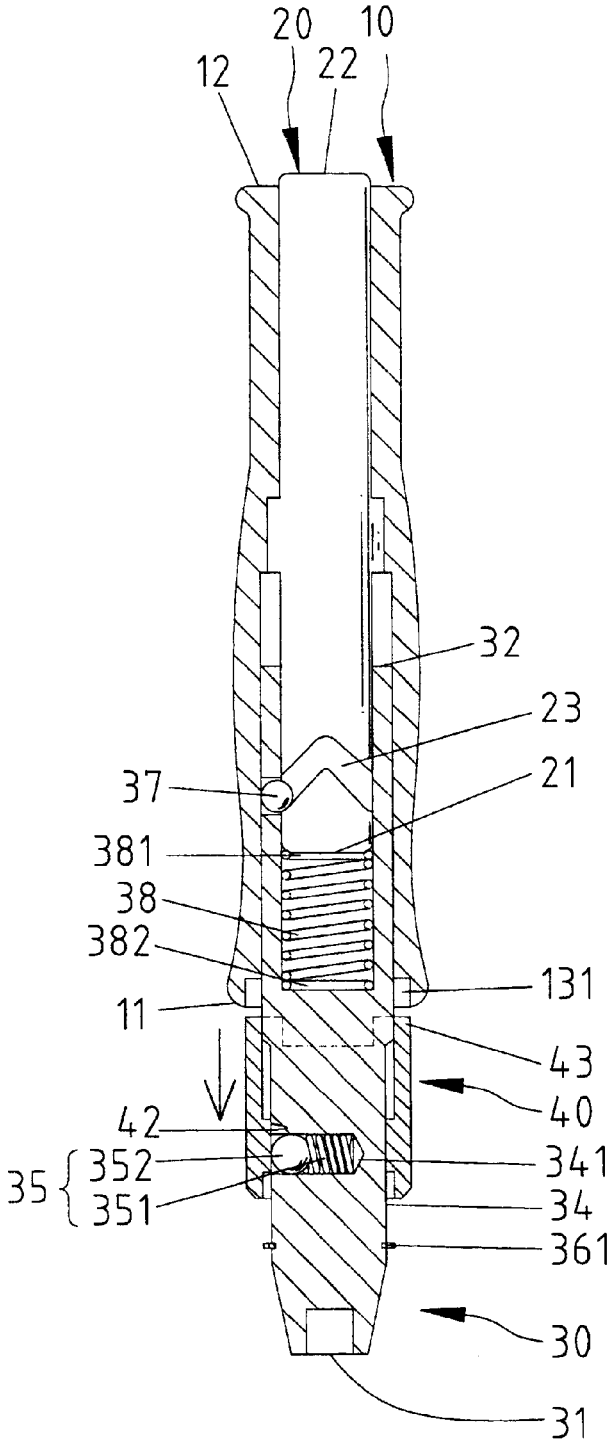
FIG. 4 is similar to FIG. 3 but showing the hand tool in another position.
Figure 5:
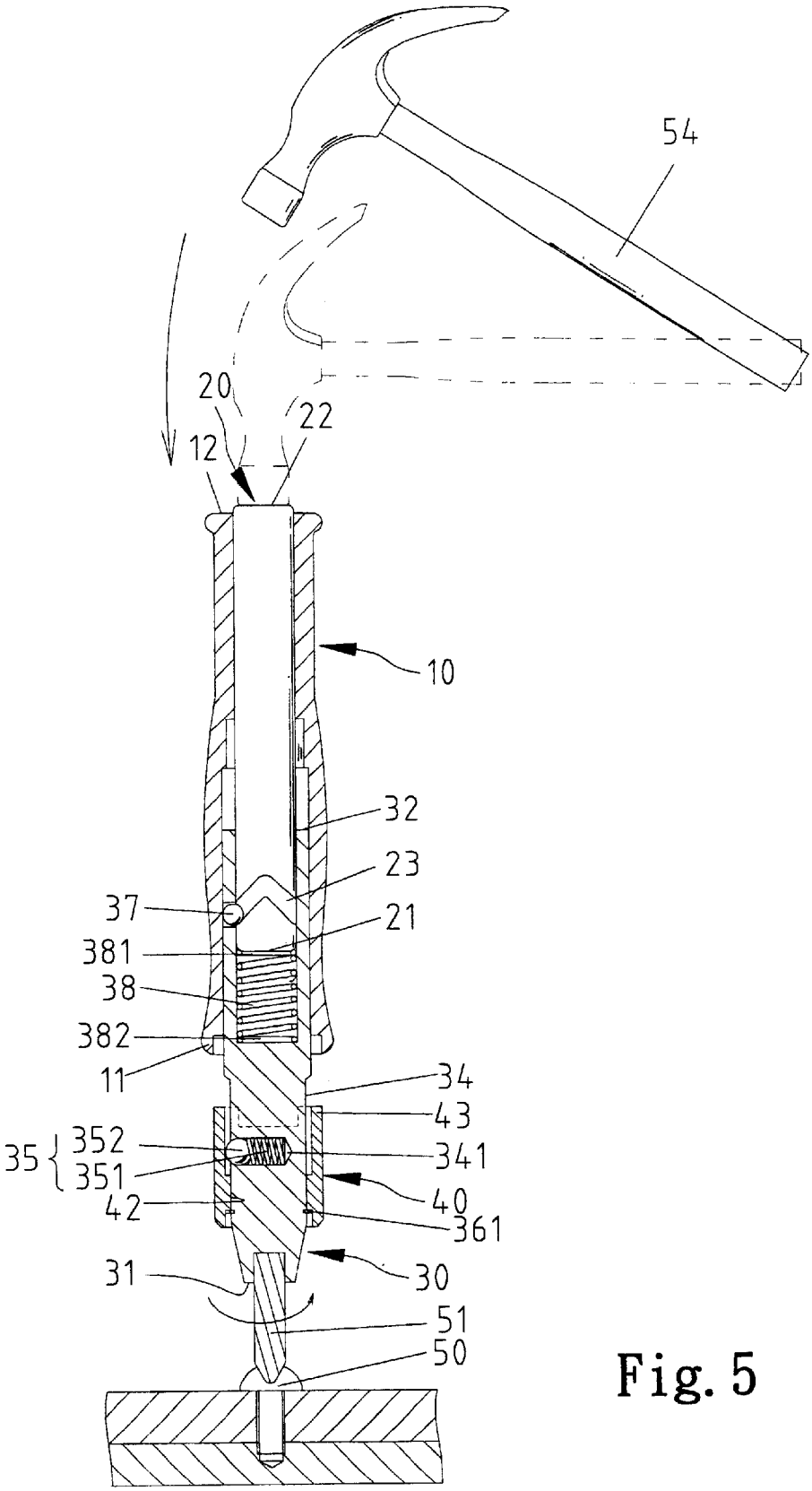
FIG. 5 is similar to FIG. 4 but showing the hand tool subject to a blow by a hammer.

Referring to FIG. 4, the hand tool is in a mode for transforming a blow into a torque for driving the tool bit 51. The extensions 43 are removed from the recesses 131, thus allowing rotation of the handle 10 relative to the clutch 40, i.e., the handle 10 cannot drive the clutch 40 and therefore the driver 30 and the tool bit 51. However, when a blow is exerted on the second end 22 of the plunger 20 by means of a hammer 54 as shown in FIG. 5, the plunger 20 is moved downwards. The first branch of the V-shaped groove 23 causes the ball 37 and therefore the driver 30 to rotate in a direction indicated by means of an arrow shown in FIG. 5.

Figure 6:
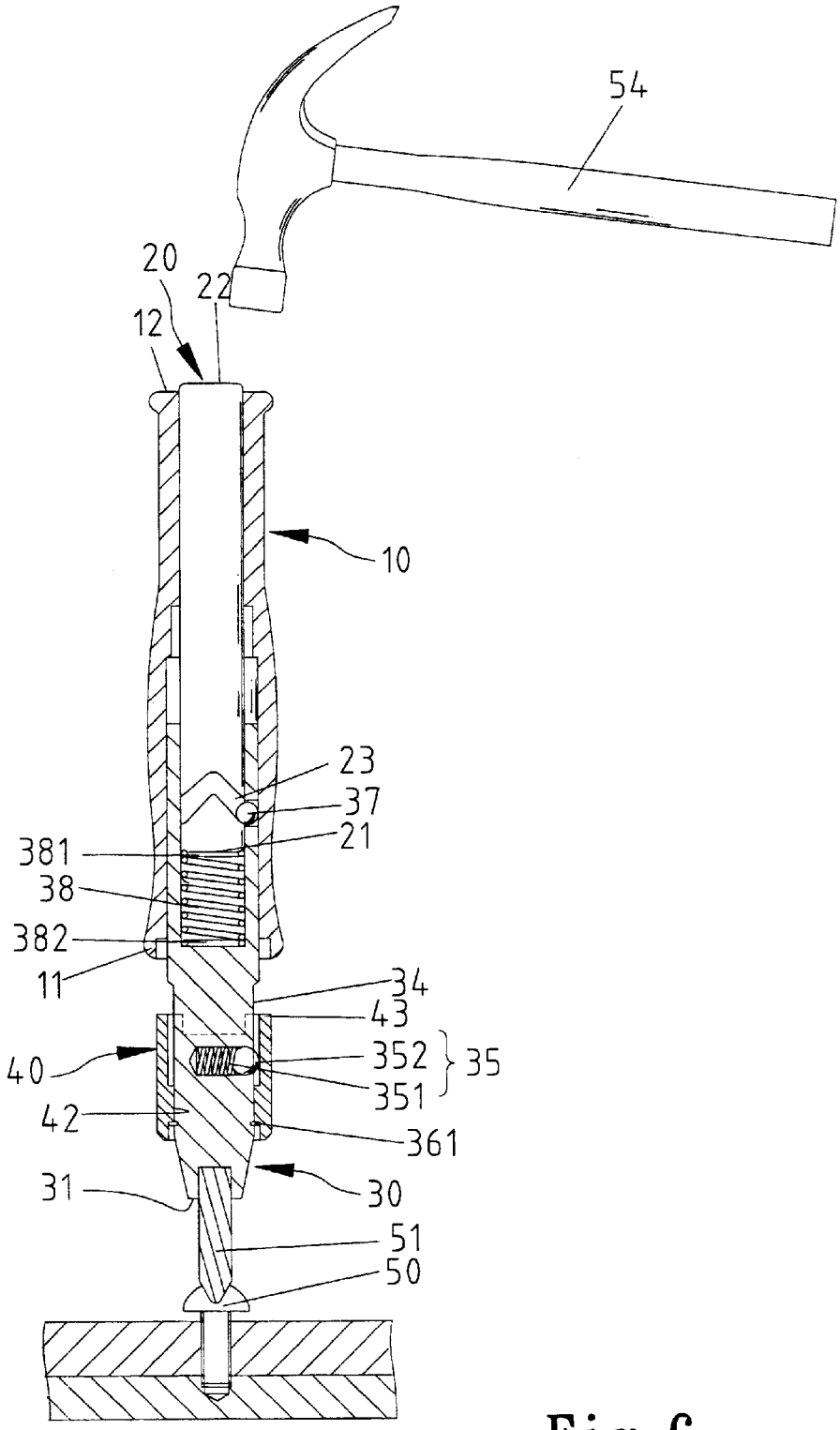
FIG. 6 is similar to FIG. 5 but showing the hand tool in another position.
Figure 7:
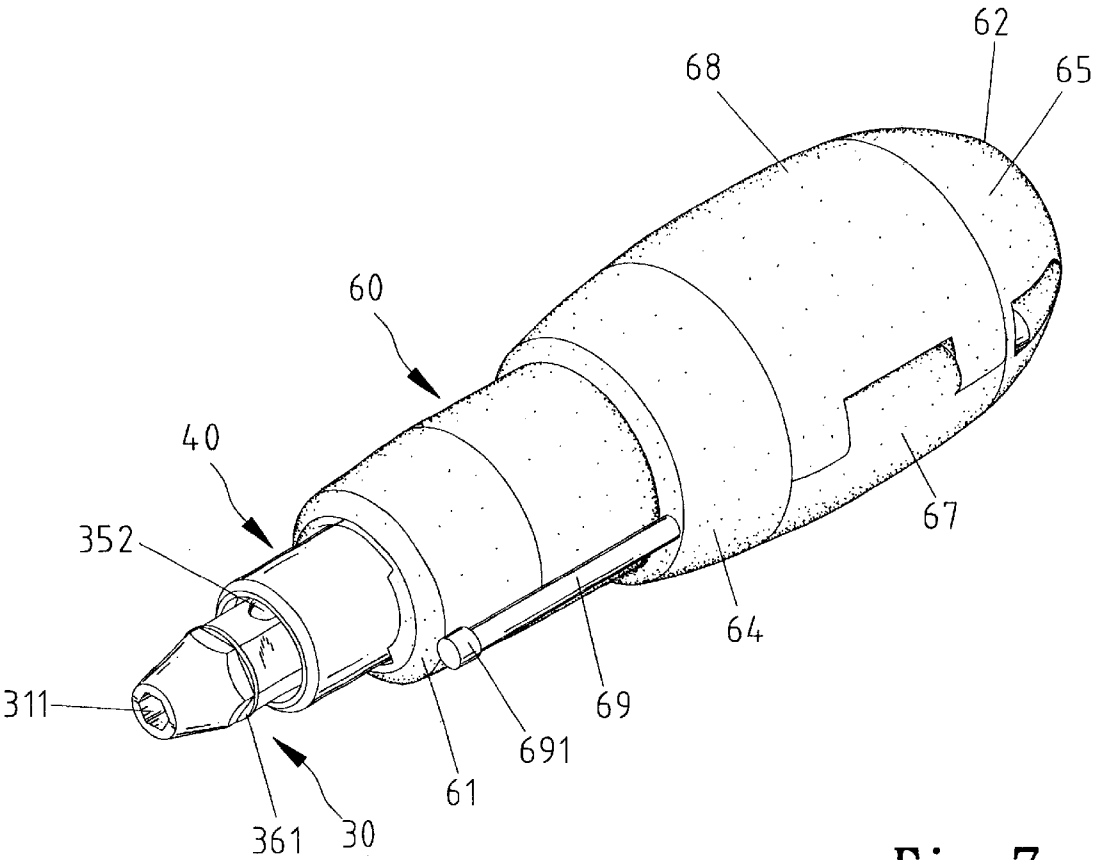
FIG. 7 is a perspective view of a hand tool according to a second embodiment of the present invention.

The ball 37 can be moved from the first branch of the V-shaped groove 23 as shown in FIG. 5 to the second branch of the V-shaped groove 23 as shown in FIG. 6. When a blow is exerted on the second end 22 of the plunger 20 by means of a hammer 54, the plunger 20 is moved downwards. The second branch of the V-shaped groove 23 causes the ball 37 and therefore the driver 30 to rotate in a direction indicated by means of an arrow shown in FIG. 6.

FIGS. 7 to 11 show a hand tool according to a second embodiment of the present invention. The second embodiment is identical to the first embodiment except for using a handle 60 in place of the handle 10 in order to carry tool bits.

Figure 8:
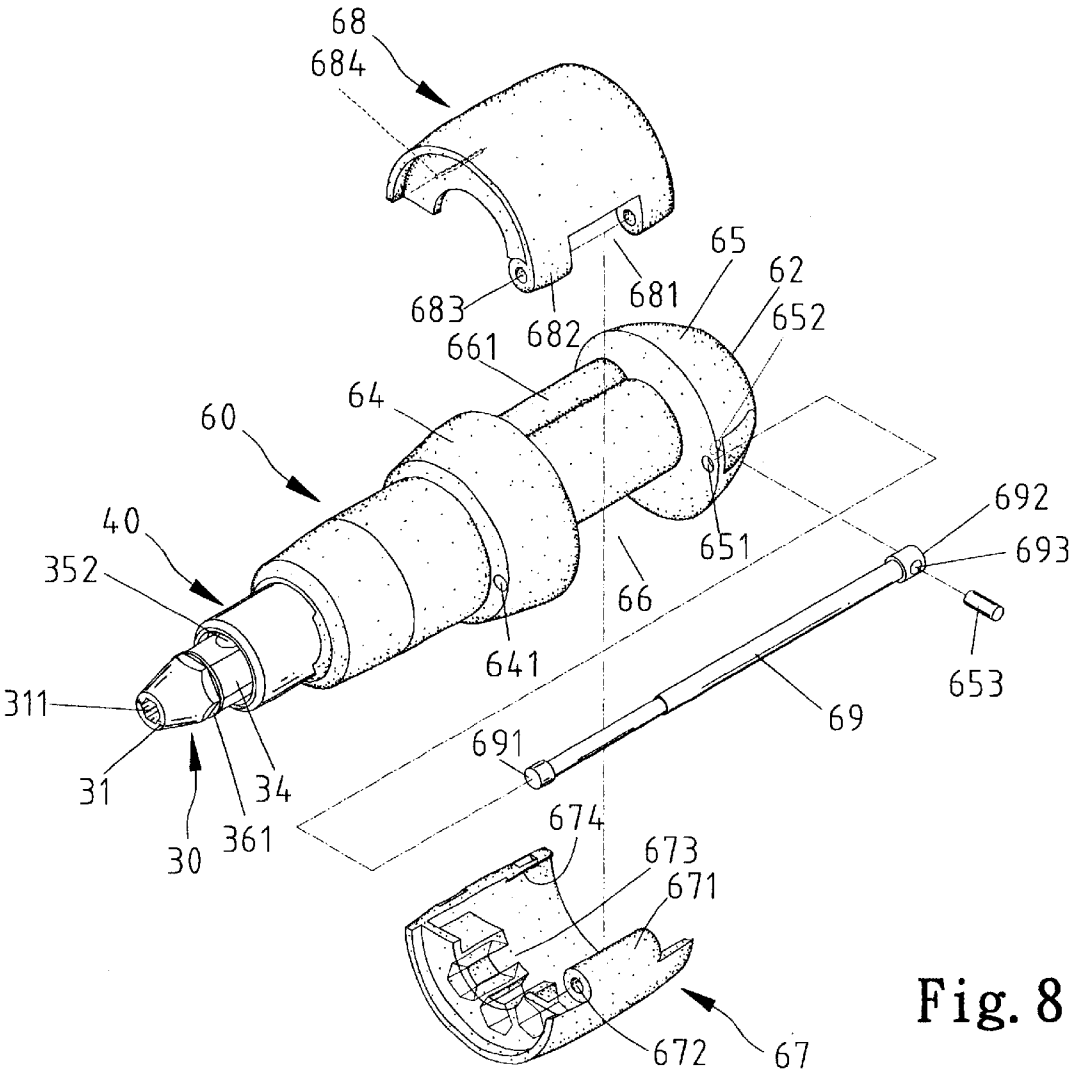
FIG. 8 is an exploded view of the hand tool shown in FIG. 7.

Referring to FIG. 8, the handle 60 is identical to the handle 10 except for adopting an arrangement for carrying tool bits. The handle 60 is found with a first open end 61 and a second end 62. The arrangement includes a first annular portion 64 and a second annular portion 65 separated from each other. A hole 641 axially extends through the first annular portion 64. A hole 651 axially extends through the second annular portion 65, corresponding to the hole 641. A hole 652 extends in the second annular portion 65 in a radial direction.

A cylindrical portion 66 is formed between the annular portions 64 and 65. The cylindrical portion 66 is formed with a ridge 661 extending axially. A recess 662 is defined in the ridge 661.

A first shell 67 includes, on an edge thereof, a tubular portion 671 defining a hole 672. A semi-circular thick portion (not numbered) is formed on an internal periphery of the first shell 67. Several hexangular recesses 673 are defined in the semi-circular thick portion of the first shell 67 in order to receive tool bits 70. A flange 674 is formed on another edge of the first shell 67.

Figure 9:
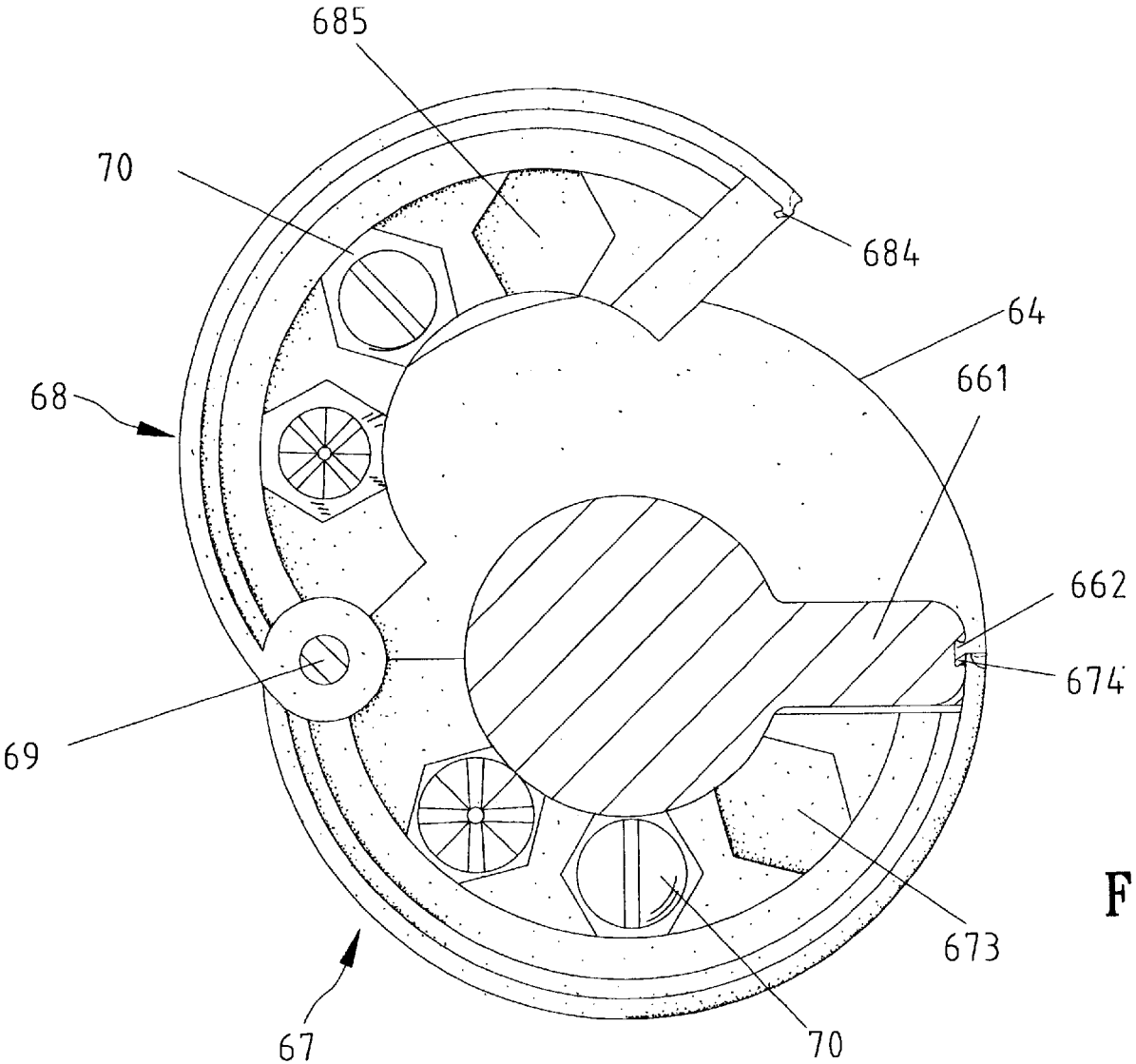
FIG. 9 is a cross-sectional view of the hand tool shown in FIG. 8.

A second shell 68 includes, on an edge thereof, two tubular portions 682 separated from each other by a gap 681. Each of the tubular portions 682 defines a hole 683. A semi-circular thick portion (not numbered) is formed on an internal periphery of the second shell 68. A flange 684 is formed on another edge of the second shell 68. Referring to FIG. 9, several hexangular recesses 685 are defined in the semi-circular thick portion of the second shell 68 in order to receive tool bits 70.

A telescopic element 69 includes a first end 691 that is magnetic and a second end 692 in which a hole 693 is defined.

Figure 10:
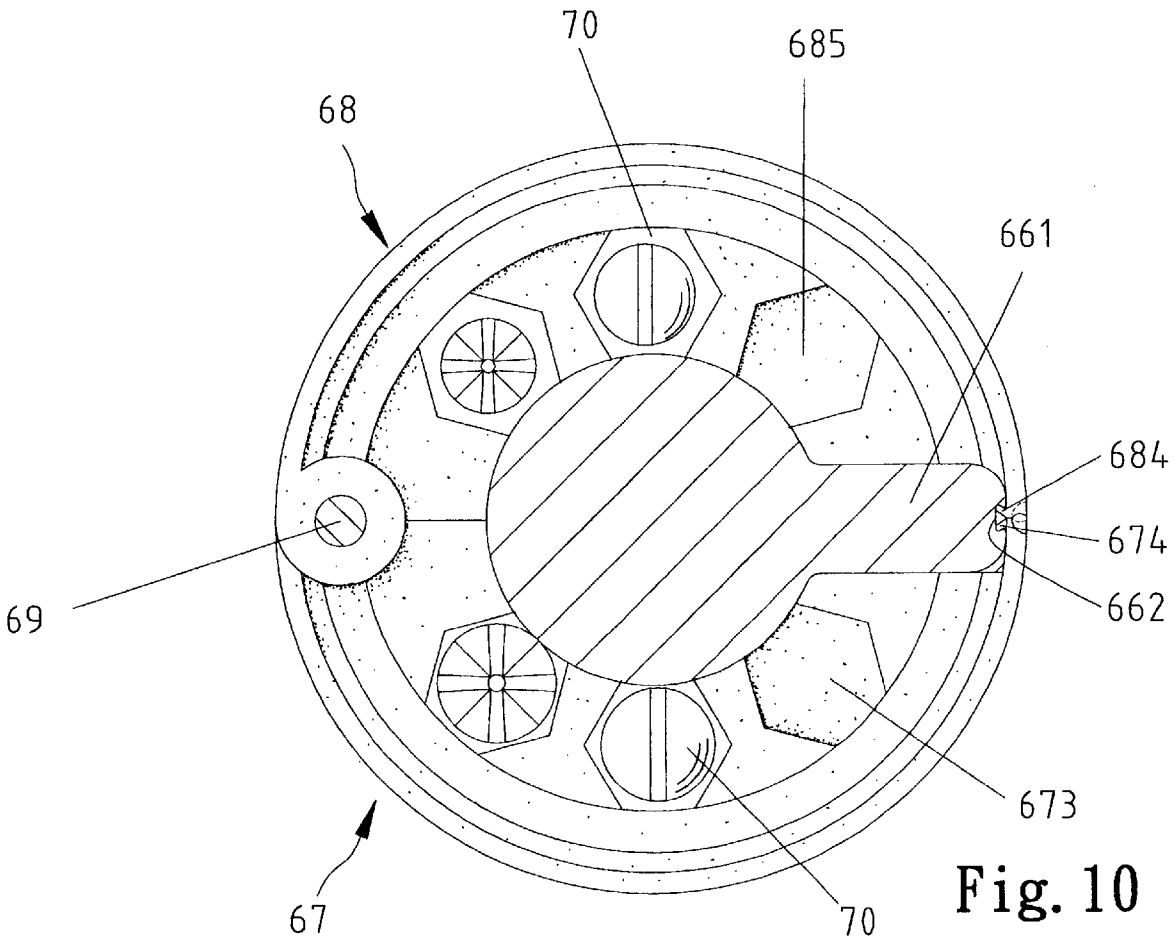
FIG. 10 is similar to FIG. 9 but showing the hand tool in another position.
Figure 11:
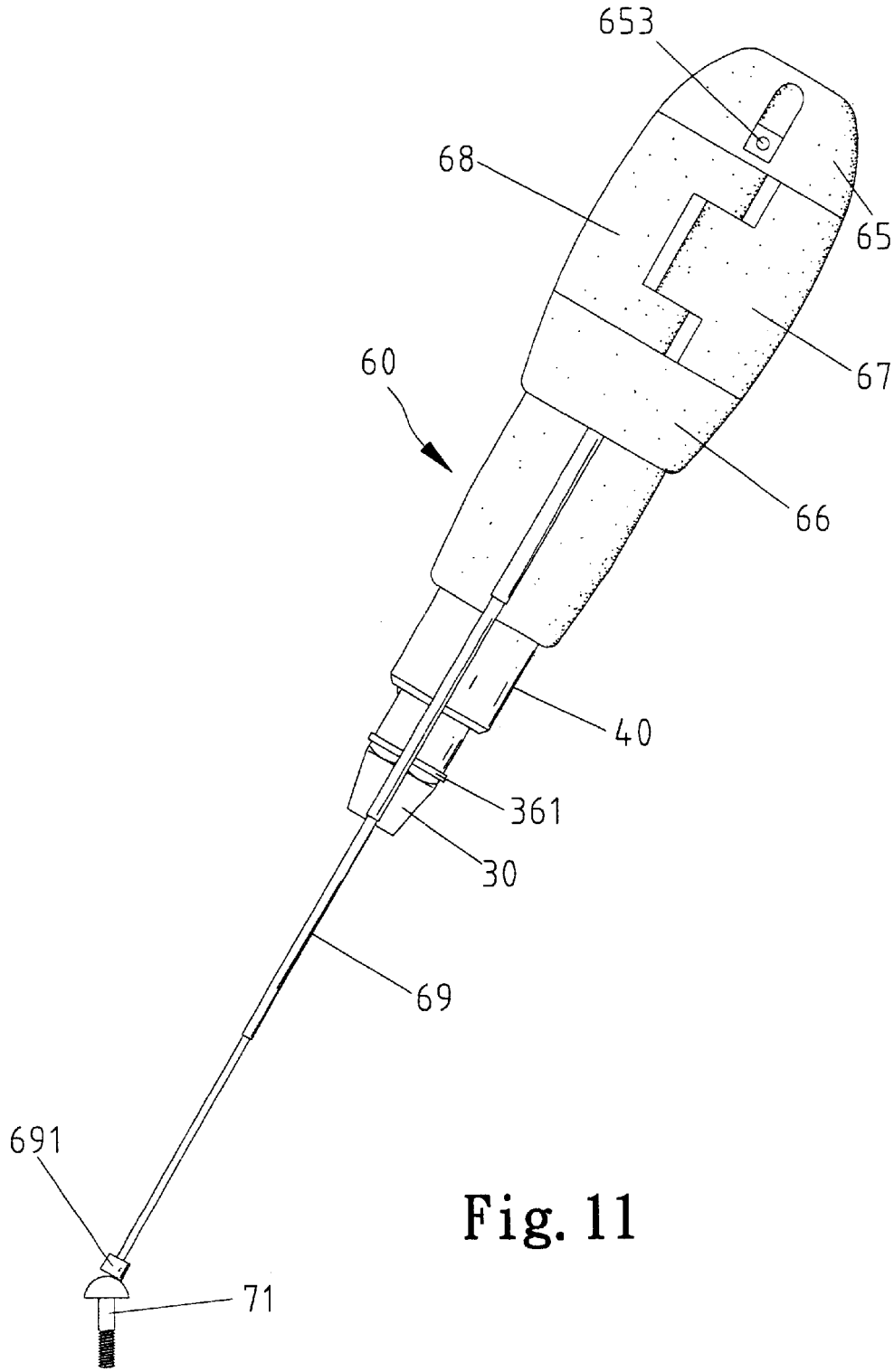
FIG. 11 is a side view of the hand tool shown in FIG. 8.
Figure 12:
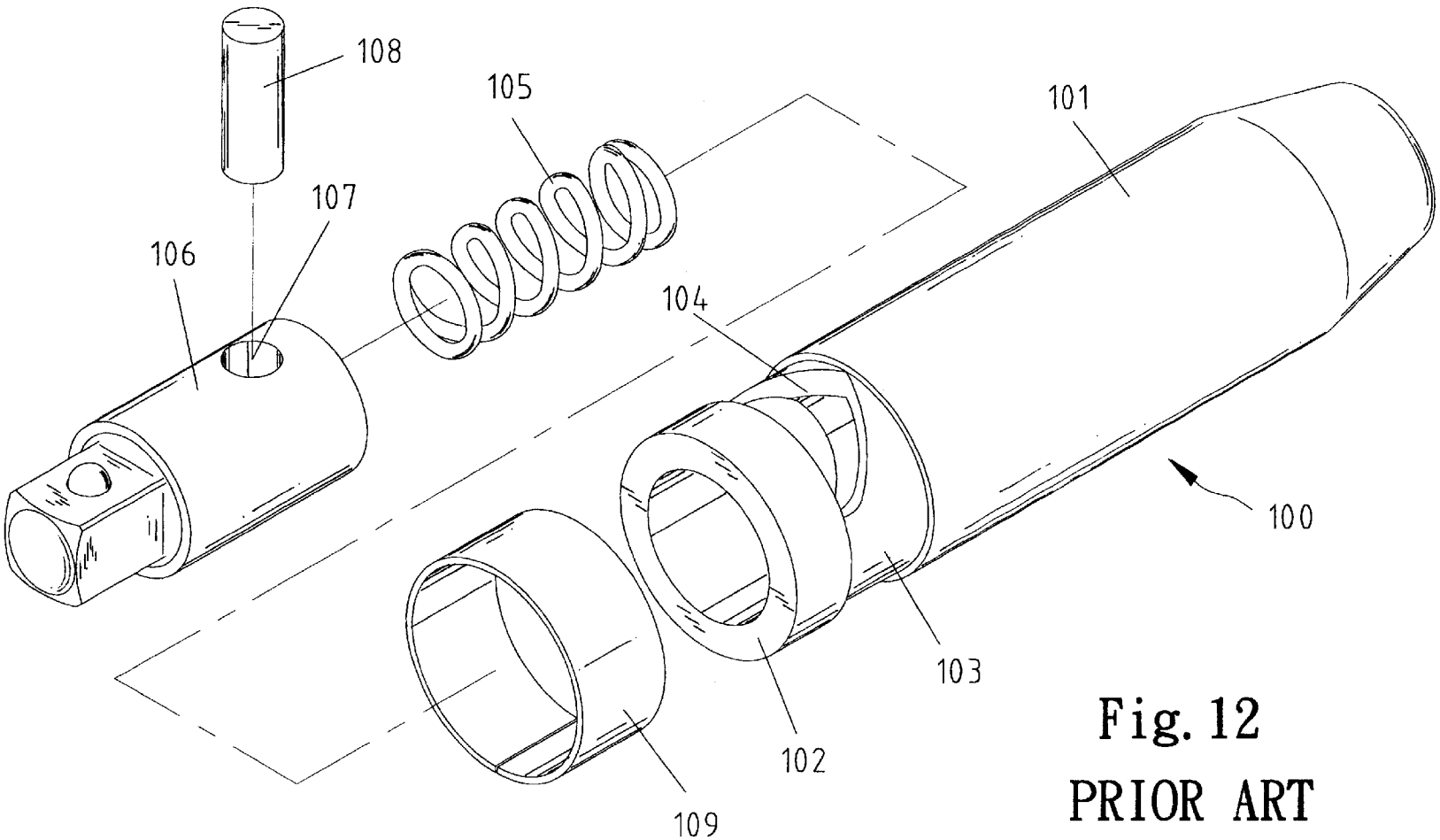
Fig. 12 PRIOR ART
FIG. 12 is an exploded view of a conventional hand tool.

In assembly, the shells 67 and 68 are located between the annular portions 64 and 65. The tubular portion 671 of the first shell 67 is positioned between the tubular portions 682 of the second shell 68. The holes 672 and 683 are aligned with the holes 641 and 651. The telescopic element 69 is inserted in the holes 651, 683, 672 and 641 like a shaft. A pin 653 is inserted in the hole 693 and the hole 652, thus securing the telescopic element 69 to the second annular portion 65. Thus, the shells 67 and 68 can be pivoted between an open position as shown in FIG. 9 and a closed position as shown in FIG. 10. The flanges 674 and 684 can be received in the recess 662 in order to retain the shells 67 and 68 in the closed position. The telescopic element 69 can be extended as shown in FIG. 11 so that the first end 691 can attract a thread bolt 71 trapped in a narrow space.

The preferred embodiment of the present invention has been described in detail for illustrative purposes. Those skilled in the art can derive a lot of variations from these embodiments after a study of this patent specification. Therefore, these embodiments shall by no means limit the scope of the present invention. The scope of the present invention can only be defined in the attached claims.

What is claimed is:

1. A hand tool including:

a handle being hollow;

a plunger including a first end and a second end, the plunger being inserted in the handle so that the plunger cannot rotate relative to the handle and that the second end extends beyond the handle;

an elastic element received in the handle;

a driver including a first section for engagement with a tool bit and a second section received in the handle so that the second section can rotate relative to the handle;

a device for transforming a blow on the second end of the plunger into a torque on the second section of the driver;

a clutch mounted on the first section of the driver so that the clutch cannot rotate relative to the driver and can move between a first position where the clutch cannot rotate relative to the handle and a second position where the clutch can rotate relative to the handle; and a telescopic element attached to the handle and including a magnetic end.

2. The hand tool according to claim 1 wherein the clutch is shaped as a collar so that the clutch can be mounted on the first section of the driver.

3. The hand tool according to claim 2 wherein the first section of the driver includes a periphery consisting of at least three facets and the clutch includes an internal periphery consisting of a plurality of facets corresponding to that of the first section of the driver.

4. The hand tool according to claim 3 wherein the periphery of the first section of the driver consists of six facets.

5. The hand tool according to claim 3 wherein the device for transforming a blow on the second end of the plunger into a torque on the second section of the driver includes a V-shaped groove defined in one of the plunger and the second section of the driver and a recess defined in the remaining one of the plunger and the second section of the driver.

6. The hand tool according to claim 1 including a device formed around the handle for storing tool bits.

7. The hand tool according to claim 6, wherein the storing device includes at least one shell pivotally mounted on the handle for carrying tool bits.

8. The hand tool according to claim 7 wherein the storing device includes two shells.

9. The hand tool according to claim 8 wherein the shells each include a semi-annular portion defining a plurality of recesses in order to receive tool bits.

10. A hand tool including:

a handle being hollow;

a plunger including a first end and a second end, the plunger being inserted in the handle so that the plunger cannot rotate relative to the handle and that the second end extends beyond the handle;

an elastic element received in the handle;

a driver including a first section for engagement with a tool bit and a second section received in the handle so that the second section can rotate relative to the handle;

a device for transforming a blow on the second end of the plunger into a torque on the second section of the driver;

a clutch mounted on the first section of the driver so that the clutch cannot rotate relative to the driver and can move between a first position where the clutch cannot rotate relative to the handle and a second position where the clutch can rotate relative to the handle, wherein the clutch is shaped as a collar so that the clutch can be mounted on the first section of the driver; and a stopper for preventing the clutch escaping from the first section of the driver.

11. The hand tool according to claim 10 wherein the stopper is a C-clip received in an annular groove defined in the first section of the driver.

12. A hand tool including:

a handle being hollow;

a plunger including a first end and a second end, the plunger being inserted in the handle so that the plunger cannot rotate relative to the handle and that the second end extends beyond the handle;

an elastic element received in the handle;

a driver including a first section for engagement with a tool bit and a second section received in the handle so that the second section can rotate relative to the handle;

a device for transforming a blow on the second end of the plunger into a torque on the second section of the driver;

a clutch mounted on the first section of the driver so that the clutch cannot rotate relative to the driver and can move between a first position where the clutch cannot rotate relative to the handle and a second position where the clutch can rotate relative to the handle, wherein the clutch is shaped as a collar so that the clutch can be mounted on the first section of the driver; and a retainer for retaining the clutch in the second position in a releasable manner.

13. The hand tool according to claim 12 wherein the retainer includes a spring and a ball both received in a hole defined in the first section of the driver.

14. A hand tool including:

a handle being hollow;

a plunger including a first end and a second end, the plunger being inserted in the handle so that the plunger cannot rotate relative to the handle and that the second end extends beyond the handle;

an elastic element received in the handle;

a driver including a first section for engagement with a tool bit and a second section received in the handle so that the second section can rotate relative to the handle;

a device for transforming a blow on the second end of the plunger into a torque on the second section of the driver; and a clutch mounted on the first section of the driver so that the clutch cannot rotate relative to the driver and can move between a first position where the clutch cannot rotate relative to the handle and a second position where the clutch can rotate relative to the handle, wherein the clutch is shaped as a collar so that the clutch can be mounted on the first section of the driver, wherein the handle defines at least one recess and the clutch includes at least one extension corresponding to the at least one recess defined in the handle so that the at least one extension of the clutch is received in the recess defined in the handle in the first position and that the at east one extension of the clutch is removed from the recess defined in the handle in the second position.

15. The hand tool according to claim 14 wherein the at least one recess is defined in an internal periphery of the handle.

16. The hand tool according to claim 14 wherein the at least one extension projects from an end of the clutch.

17. The hand tool according to claim 14 wherein the handle defines two recesses.

18. A hand tool including:

a handle being hollow;

a plunger including a first end and a second end, the plunger being inserted in the handle so that the plunger cannot rotate relative to the handle and that the second end extends beyond the handle;

an elastic element received in the handle;

a driver including a first section for engagement with a tool bit and a second section received in the handle so that the second section can rotate relative to the handle;

a device for transforming a blow on the second end of the plunger into a torque on the second section of the driver; and a clutch mounted on the first section of the driver so that the clutch cannot rotate relative to the driver and can move between a first position where the clutch cannot rotate relative to the handle and a second position where the clutch can rotate relative to the handle, wherein the handle includes at least one groove defined in an internal periphery thereof and the plunger includes at least one guide received in the at least one groove defined in the handle.

19. The hand tool according to claim 18 wherein the handle includes two grooves.

* * * * *